US010050375B1

(12) United States Patent
Semple et al.

(10) Patent No.: US 10,050,375 B1
(45) Date of Patent: Aug. 14, 2018

(54) DIRECT CONDUCTOR SEAL FOR SUBMERSIBLE PUMP ELECTRICAL CONNECTOR

(71) Applicant: Baker Hughes, a GE Company, LLC, Houston, TX (US)

(72) Inventors: Ryan Semple, Owasso, OK (US); David Tanner, Broken Arrow, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

(21) Appl. No.: 15/727,319

(22) Filed: Oct. 6, 2017

(51) Int. Cl.
*H01R 13/52* (2006.01)
*E21B 47/12* (2012.01)
*E21B 17/02* (2006.01)

(52) U.S. Cl.
CPC ..... *H01R 13/5205* (2013.01); *E21B 17/028* (2013.01); *E21B 47/12* (2013.01); *H01R 13/521* (2013.01)

(58) Field of Classification Search
CPC ... E21B 17/028; E21B 47/12; H01R 13/5202; H01R 13/5205; H01R 13/5221; H01R 13/521
USPC ..... 439/589, 271–275, 587
See application file for complete search history.

(56) References Cited

U.S. PATENT DOCUMENTS 4,673,231 A * 6/1987 McAnulty, Sr. ..... H02G 15/14 439/271
5,035,638 A * 7/1991 Kourimsky ..... H01R 24/20 439/275
6,361,342 B1 3/2002 Cox
6,676,447 B1 1/2004 Knox
6,780,037 B1 8/2004 Parmeter et al.
7,575,458 B2 8/2009 Parmeter et al.
7,789,689 B2 9/2010 Frey et al.
7,942,696 B2 * 5/2011 Watson ..... E21B 17/023 439/589
8,512,074 B2 8/2013 Frey
9,397,440 B2 * 7/2016 Mori ..... H01R 13/504
9,458,705 B2 10/2016 Semple et al.
9,709,043 B2 * 7/2017 Gilmore ..... F04B 17/03
9,735,498 B2 * 8/2017 Katsube ..... H01R 13/5216
2016/0102659 A1 4/2016 Gilmore et al.

* cited by examiner

*Primary Examiner* — Tulsidas C Patel
*Assistant Examiner* — Travis Chambers
(74) *Attorney, Agent, or Firm* — Bracewell LLP; James E. Bradley

(57) ABSTRACT

An electrical connector for downhole well equipment has a housing having a cavity. A rigid rearward insulator is sealed within the cavity, the rearward insulator having a rearward insulator passage. An electrical conductor has an insulation layer and extends in a forward direction into the rearward insulator passage. An electrical connector terminal joins to a tip of the conductor. The insulation layer has a forward end spaced rearward from the connector terminal, defining an exposed portion of the conductor between the forward end of the insulation layer and the connector terminal. A grommet of resilient electrical insulation material within the rearward insulator passage has a grommet passage with a forward passage portion extending around the connector terminal and an intermediate passage portion sealing around the exposed portion. The grommet has an outer surface in sealing engagement with the rearward insulator passage.

20 Claims, 5 Drawing Sheets

DIRECT CONDUCTOR SEAL FOR SUBMERSIBLE PUMP ELECTRICAL CONNECTOR

FIELD OF THE DISCLOSURE

This disclosure relates in general to power cable connectors for electrical submersible well pumps, and in particular to a connector that has a sealing arrangement that seals directly to the electrical conductor rather than to the insulation layer of the conductor.

BACKGROUND

Electrical submersible well pumps (ESP) are often used to pump liquids from hydrocarbon producing wells. A typical ESP includes a pump driven by an electrical motor. Production tubing, which comprises pipes having threaded ends secured together, supports the ESP in most installations. The pump normally pumps well fluid into the production tubing. A power cable extends alongside the production tubing to the motor for supplying power.

In one type of ESP, the power cable normally has on a lower end a splice that connects it to a motor lead. The motor lead extends alongside the ESP and has a motor connector or pothead on its lower end that connects to an upper end of the motor to supply power. The motor lead may have three conductors bundled together, one for each phase of power being supplied. Alternately, the motor lead may comprise three separate metal tubes, each containing one of the power conductors, and each having a connector on the lower end.

A variety of motor connectors are known. Most include a connector housing with a rigid insulator located in a cavity. The power conductor joins an electrical connector terminal. The insulation layer on the power conductor abuts the rearward end of the connector terminal. A resilient insulator within the rigid insulator seals around the insulation layer of the power conductor. The resilient insulator thus compresses the portion of the insulation layer that it seals against.

While successful, there is a fine line between too little stress on the insulation layer and not making a seal, and putting too much stress on the insulation layer, pinching it. The pinching could cause a leak and electrical failure.

SUMMARY

An electrical connector for downhole well equipment has a housing having a cavity. A rigid rearward insulator seals within the cavity, the rearward insulator having a rearward insulator passage therethrough. An electrical conductor having an insulation layer extends in a forward direction into the rearward insulator passage. An electrical connector terminal joins to a tip of the conductor. The insulation layer has a forward end spaced a selected distance rearward from the connector terminal, defining an exposed portion of the conductor between the forward end of the insulation layer and the connector terminal. A grommet of resilient electrical insulation material is within the rearward insulator passage. The grommet has a grommet passage with a forward passage portion extending around the connector terminal, an intermediate passage portion sealing around the exposed portion, and an outer surface in sealing engagement with the rearward insulator passage.

The forward passage portion may have a larger diameter than the intermediate passage portion. The grommet passage has a rearward passage portion that surrounds the insulation layer. The rearward passage portion also may have a larger diameter than the intermediate passage portion, defining a rearward facing shoulder at a junction between the rearward passage portion and the intermediate passage portion.

In the embodiments shown, a forward insulator of a rigid electrical insulating material is located in the cavity. The forward insulator has a forward insulator passage that registers with the rearward insulator passage. The forward insulator passage has a rearward facing shoulder that faces a forward facing shoulder in the rearward insulator passage. The grommet has a rearward facing surface in abutment with the forward facing shoulder in the rearward insulator passage.

In the embodiment shown, an insulation sleeve seals around the rearward portion of the grommet and the insulation layer. A rigid barrier sleeve is mounted within the housing passage rearward from the rearward portion of the grommet. The barrier sleeve has an outer surface that seals to the housing passage and a barrier sleeve passage through which the conductor extends.

DETAILED DESCRIPTION OF THE DISCLOSURE

Figure 1:
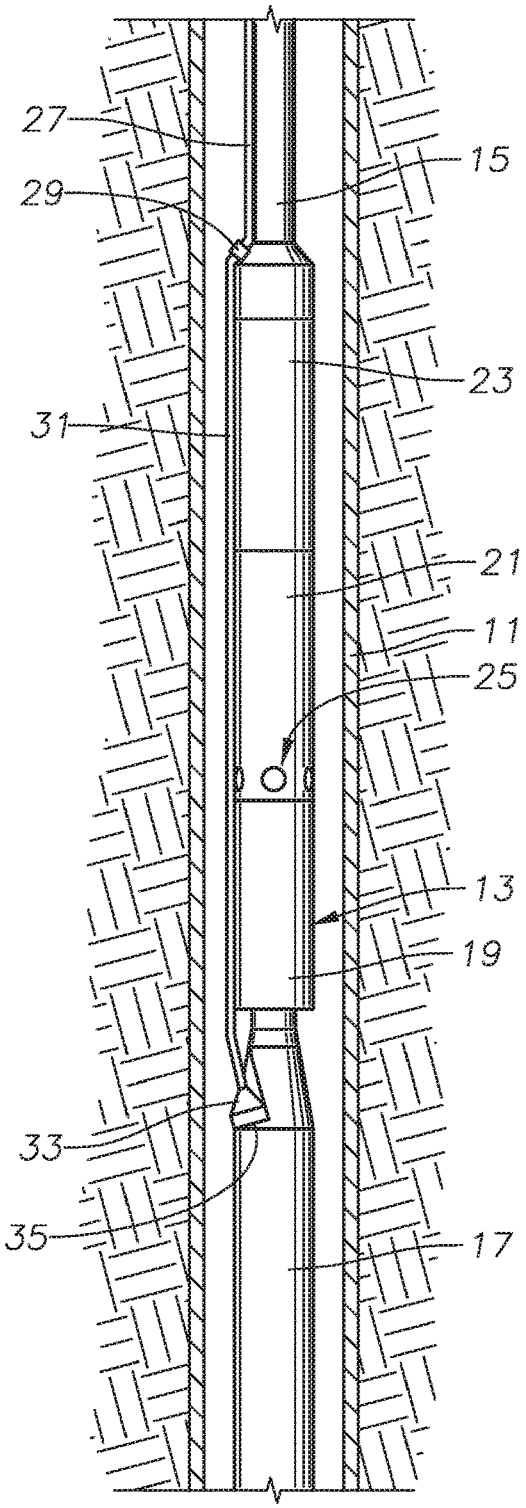
FIG. 1 is a schematic side view of an electrical submersible pump suspended in a well and having an electrical motor connector in accordance with this invention.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is an elevational section view of a cased well 11 having an electrical submersible pumping system (ESP) 13 disposed therein on a string of production tubing 15. ESP 13 includes an electric motor 17, a seal/equalizer section 19, an optional gas separator 21, and a pump 23. Pump 23 may comprise a centrifugal pump or another type, such as a progressing cavity pump. Fluid inlets 25 are shown provided on separator 21 for providing a passage for receiving fluid into pump 23. A power cable 27 extends downhole alongside tubing 15, terminating in a splice or connection 29 that electrically couples power cable 27 to a motor lead 31, which may be considered to be part of power cable 27. Motor lead 31 has a pothead or motor connector 33 on its lower end that electrically connects and secures motor lead 31 to a receptacle 35 of electric motor 17. Alternately, power cable 27 can extend all the way from the surface to motor connector 33, thereby eliminating the need for cable connection 29.

Figure 2:
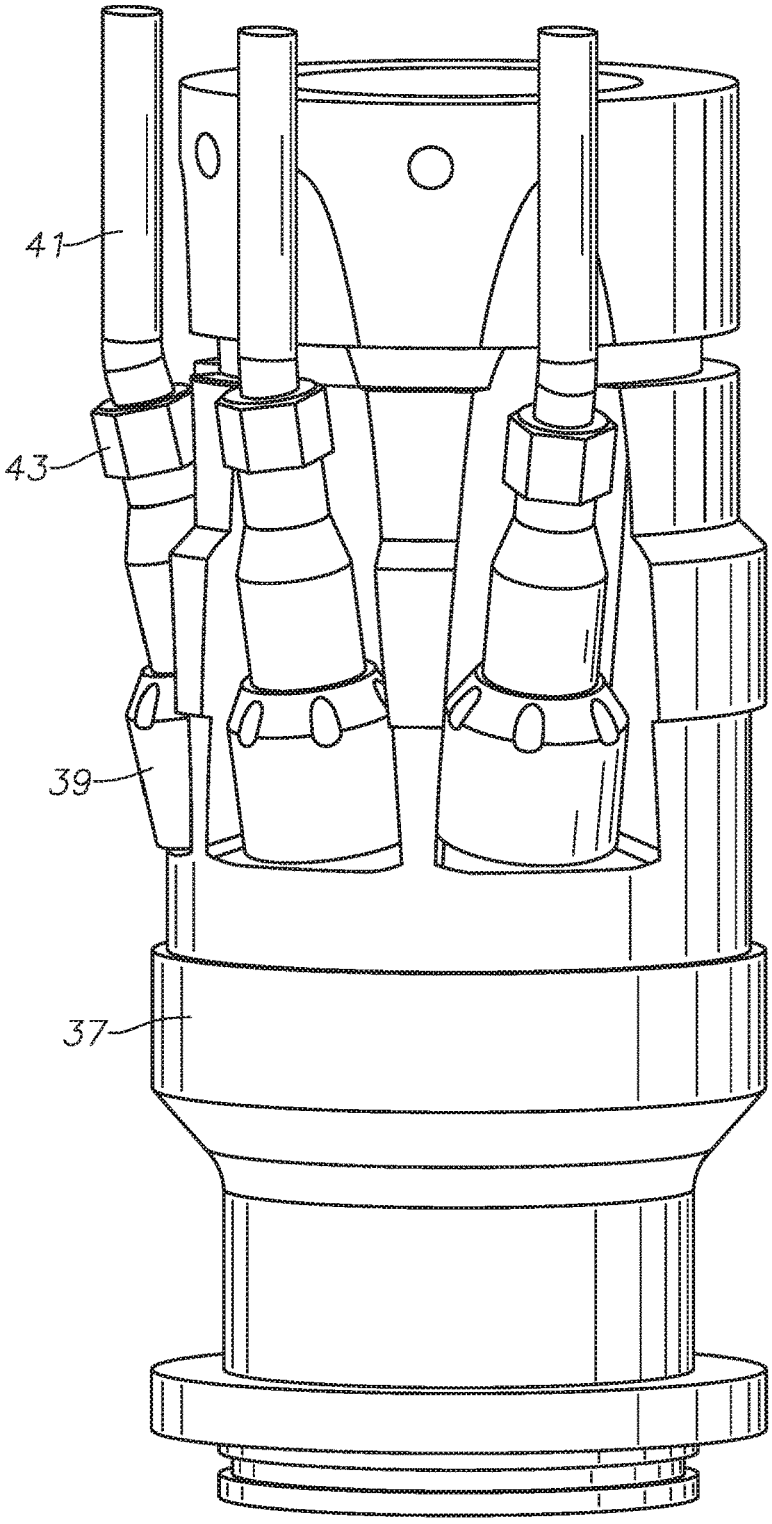
FIG. 2 is a side view of an alternate embodiment of an electrical motor connector arrangement, showing three separate electrical motor connectors.

In FIG. 1, motor lead 31 has three separate power conductors bundled together that terminate in a single motor connector 33. FIG. 2 shows an alternate arrangement wherein motor head 37 has three separate motor connectors 39 secured to it. The motor lead in this example includes three separate hard tubes 41, such as formed of Monel, that extend up to a connection or splice with power cable 27 (FIG. 1). A compression fitting 43 secures each hard tube 41 to one of the motor connectors 39. A single power conductor extends through each tube 41 and into motor connector 39 for electrical contact with a motor wire within motor 17 (FIG. 1).

Figure 3:
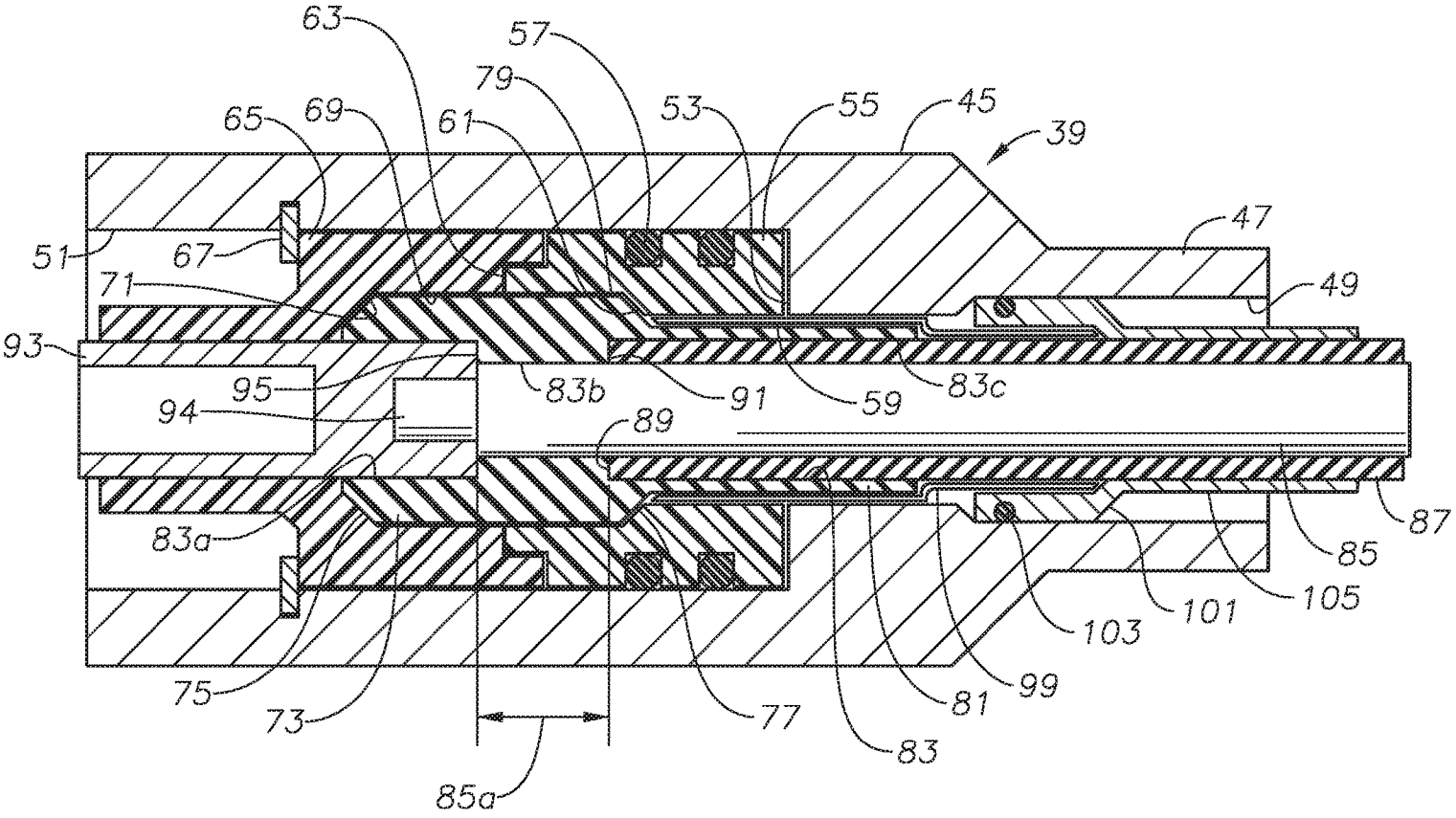
FIG. 3 is a sectional view of part of one of the electrical connectors of FIG. 2.

FIG. 3 illustrates inner components of motor connector 39, but the same components would also be used in motor connector 33 (FIG. 1), which contains three power conductors rather than one. Motor connector 39 has a connector housing 45 that is shown schematically. Connector housing 45 has a neck 47 of smaller diameter on an upward end. Because ESP 13 (FIG. 1) may be installed in other orientations than vertical, "upward" is referred to herein as a "rearward", and "downward" is referred to herein as "forward". Neck 47 will have features for connecting to a power conductor of power cable 27 (FIG. 1). The forward end of connector housing 45 has features for securing to motor head 37 (FIG. 2).

A housing passage 49 extends through housing 45 from its rearward end to a cylindrical housing cavity 51 of larger diameter than housing passage 49. The junction of housing passage 49 with housing cavity 51 defines an annular forward facing shoulder 53 in housing cavity 51. Housing cavity 51 extends from forward facing shoulder 53 to the forward end of housing 45.

An electrical upper or rearward insulator 55 fits within housing cavity 51. Rearward insulator 55 is rigid and is formed of an electrical insulation material. Annular seal rings 57 seal the outer diameter of rearward insulator 55 to the inner diameter of cavity 51. Rearward insulator 55 has a rearward facing end that abuts cavity forward facing shoulder 53. Rearward insulator 55 has a rearward insulator passage 59 that extends through it from its rearward end to its forward end. Rearward insulator passage 59 has a smaller diameter portion and a larger diameter portion, defining a forward facing shoulder 61. Forward facing shoulder 61 may be conical, as shown. Rearward insulator 55 has a forward end 63.

In this embodiment, a lower or forward insulator 65 within housing cavity 51 abuts rearward end 63 of rearward insulator 55. Forward insulator 65 is also rigid and formed of an electrical insulation material. In this example, a retaining or snap ring 67 secures to a groove in housing cavity 51 and retains forward insulator 65 and rearward insulator 55 in housing cavity 51. Other arrangements to secure insulators 65, 55 in housing cavity 51 are feasible.

A forward insulator passage 69 extends through forward insulator 65 from its rearward end to its forward end coaxially with rearward insulator passage 59 and housing passage 49. In this example, forward insulator passage 69 has a larger diameter portion that defines a rearward facing shoulder 71 spaced forward from insulator forward facing shoulder 61. Rearward facing shoulder 71 may also be conical, as shown.

A boot seal or grommet 73 formed of resilient elastomeric material fits within rearward insulator passage 59 and within a rearward portion of forward insulator passage 69. In this example, grommet 73 has an external forward facing surface or shoulder 75 that abuts forward insulator passage rearward facing shoulder 71. Grommet 73 has an external rearward facing surface or shoulder 77 that abuts insulator passage forward facing shoulder 61. Grommet shoulders 75, 77 may also be conical, as shown. Outer surface 79 of grommet 73 between its shoulders 75, 77 is cylindrical and forms a primary seal with rearward insulator passage 59.

Grommet 73 has an integral rearward or boot portion 81 that extends rearward from rearward facing shoulder 77 through part of rearward insulator passage 69 and into housing passage 49. Grommet rearward portion 81 has an outer diameter that is smaller than the inner diameter of the portions of rearward insulator passage 59 and housing passage 49. The outer diameter of rearward portion 81 does not seal to rearward insulator passage 59 or to housing passage 49. In this example, the length of grommet rearward portion 81 is about the same as the length of grommet outer cylindrical surface 79, but that could vary. Grommet 73 has a grommet passage 83 extending through it coaxially with housing passage 49, rearward insulator passage 59 and forward insulator passage 69. Grommet passage 83 extends from the rearward end to the forward end of grommet 73. Grommet passage 83 has a forward portion 83, an intermediate portion **83*b* of smaller diameter, and a rearward portion 83*c*** of larger diameter.

A power conductor 85 for supplying power to motor 17 (FIG. 1) extends into housing passage 49 and part of grommet passage 83. Power conductor 85 is an electrically conductive wire that is encased in one or more layers of insulation 87. Insulation layer 87 has been stripped back to create a forward end 89 of insulation layer 87. Insulation layer 87 extends into insulator passage **83*c* within grommet rearward portion 81**.

An electrical conductor connector terminal 93 joins power conductor 85 at a selected distance forward from insulation layer forward end 89. Connector terminal 93 is shown schematically and may be a variety of types, including male or female. In this example, power conductor 85 has a tip 94 that extends into a receptacle of connector terminal 93 and is joined in a conventional manner. Tip 94 is illustrated as being smaller in diameter than the remaining portion of power conductor 85, but that could differ. Grommet passage 83 has a forward facing shoulder 95 at a junction between forward passage portion **83*a* and intermediate passage portion 83*b*. Shoulder 95 is adjacent a rearward end of connector terminal 93**.

Placing conductor insulator layer forward end 89 rearward from the rearward end of connector terminal 93 results in an exposed portion **85*a* of the conductive metal of power conductor 85. Grommet intermediate passage portion 83*b* between rearward facing shoulder 91 and forward facing shoulder 95 forms a primary seal around exposed portion 85*a*. The length of exposed portion 85*a* may vary, but needs to be adequate to form a seal that can withstand a pressure differential between dielectric lubricant in motor 17 (FIG. 1) and the hydrostatic pressure of the well fluid contained in well 13 (FIG. 1). FIG. 3 shows grommet intermediate passage portion 83***b* to have the same length as conductor exposed portion 85*a*, but it could be less.

The dielectric lubricant of motor 17 is in fluid communication with the forward portion of housing cavity 51, a clearance between the outer diameter of forward insulator 65 and the inner diameter of housing cavity 51, and a clearance between the outer diameter of connector terminal 93 and the inner diameters of forward insulator passage 69 and grommet passage 83. Grommet passage forward portion 83*a* surrounds but need not seal around a rearward portion of connector terminal 93. Grommet passage rearward portion 83*c* surrounds insulation layer 87, but does not need to form a seal that can withstand a pressure differential as a high as the primary seal formed by grommet intermediate passage portion 83*b* or grommet outer portion 79. In this example, the outer diameter of insulation layer 87 is the same as the outer diameter of connector terminal 93, but that could differ.

An electrical insulation sleeve 99 of high modulus elasticity optionally may surround grommet rearward portion 81 and part of insulation layer 87. Insulation sleeve 99 may be a tape wrapped around grommet rearward portion 81 and insulation layer 87, or it may a heat shrink tube. Insulation sleeve 99 provides containment to resist rapid gas decompression of part of conductor insulator layer 87. Insulation sleeve 99 may extend from grommet rearward facing shoulder 77 a selected distance on insulation layer 87 past the rearward end of grommet rearward portion 81. The outer surface of insulation sleeve 99 does not seal to the inner diameters of rearward insulator passage 59 or housing passage 49.

A barrier sleeve 101 may be located in housing passage 49 rearward from grommet 73. Barrier sleeve 101 is a rigid member that may be formed of an electrical insulation material. Barrier sleeve 101 has an enlarged diameter forward portion that has a seal ring 103 that seals barrier sleeve 101 to housing passage 49. Barrier sleeve 101 has a rearward portion 105 that may be of smaller diameter than the forward portion. Rearward portion 105 closely receives but in this embodiment does not seal to insulation layer 87. Barrier sleeve 101 may have threads (not shown) on its exterior for securing to threads in housing passage 49. Epoxy (not shown) or another type of bonding material may be dispensed in the annular space around barrier sleeve rearward portion 105 and the inner diameter of housing passage 49. Insulation sleeve 99 extends into the larger diameter portion of barrier sleeve 101 but does not seal to it.

Grommet 73 has an initial outer diameter at outer surface 79 that is slightly larger than the inner diameter of rearward insulator 59. During assembly, insertion of grommet 73 into rearward insulator 55 radially deforms grommet 73. The radial deformation causes primary inner sealing to occur between grommet intermediate passage portion 83*b* and conductor exposed portion 85*a*. The radial deformation also causes primary outer sealing to occur between grommet outer surface 79 and the inner diameter of rearward insulator passage 59. Sealing between the outer diameter of grommet 73 and forward insulator passage 69 is not required. A technician will optionally fill the annular space around barrier sleeve 101 with epoxy, which blocks the epoxy from flowing into contact with grommet 73.

Grommet rearward portion 81 provides containment to prevent insulation layer 87 from enlarging in this area. In this embodiment, grommet rearward portion 81 does not exert sufficient squeezing on insulation layer 87 to cause as much sealing between insulation layer 87 and grommet rearward portion 81 as the inner primary seal created between grommet intermediate passage portion 83*a* and conductor exposed portion 85*a* or the outer primary seal seal created between grommet outer surface 79 and rearward insulator passage 59. Barrier sleeve 107 closely contains insulation layer 87, but does not provide sufficient squeezing on insulation layer 87 to cause as much sealing at the primary inner and outer seals. There will be no primary sealing forces exerted on the outer diameter surface of insulation layer 87, avoiding pinching of insulation layer 87.

Figure 4:
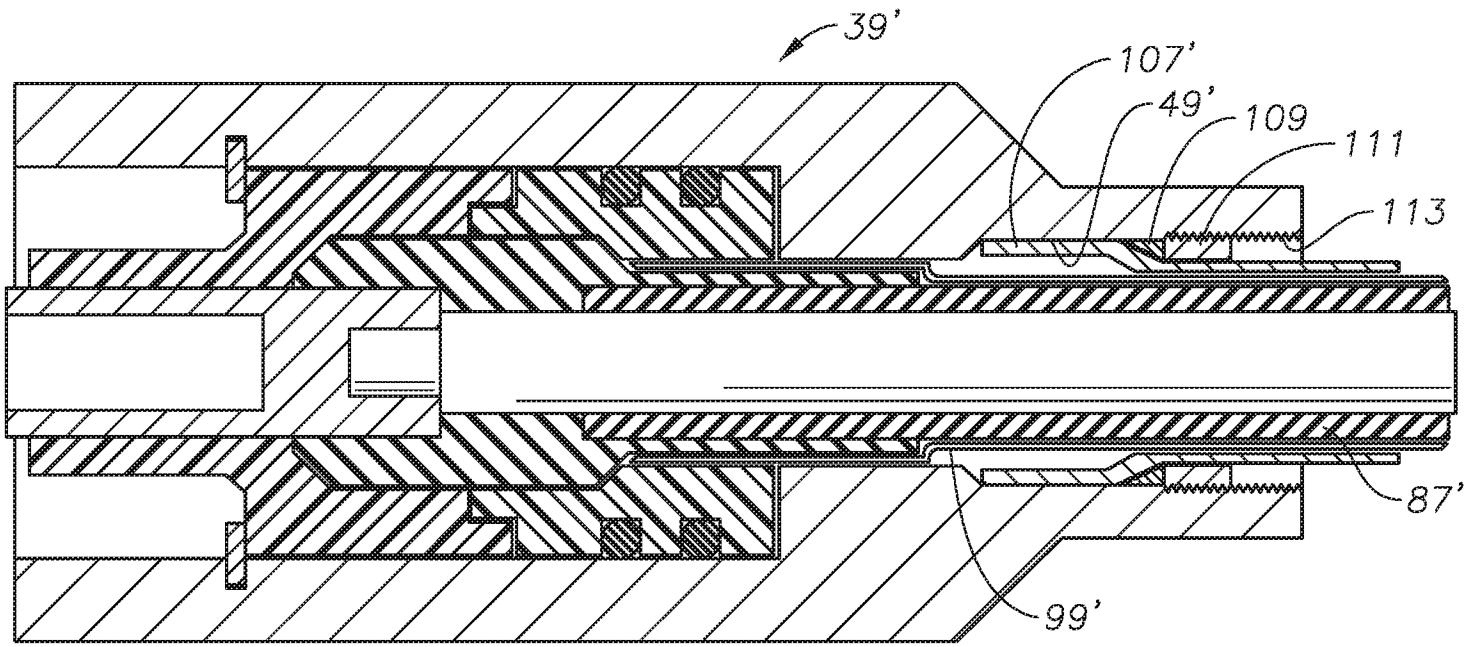
FIG. 4 is a sectional view of an alternate embodiment of the electrical connector of FIG. 3.

The components of FIG. 4 that are the same as in FIG. 3 will not be mentioned again, or if mentioned, will use the same reference numerals, but with a prime symbol. In the FIG. 4 embodiment, barrier sleeve 107' does not have an elastomeric seal ring, such as seal ring 103 (FIG. 3). Rather, a metal seal 109 seals between a conical rearward facing shoulder on barrier sleeve 107' and the inner diameter of housing passage 49'. A compression nut 111 engages threads 113 in housing passage 49' to deform seal 109 into sealing engagement with housing passage 49'.

Figure 5:
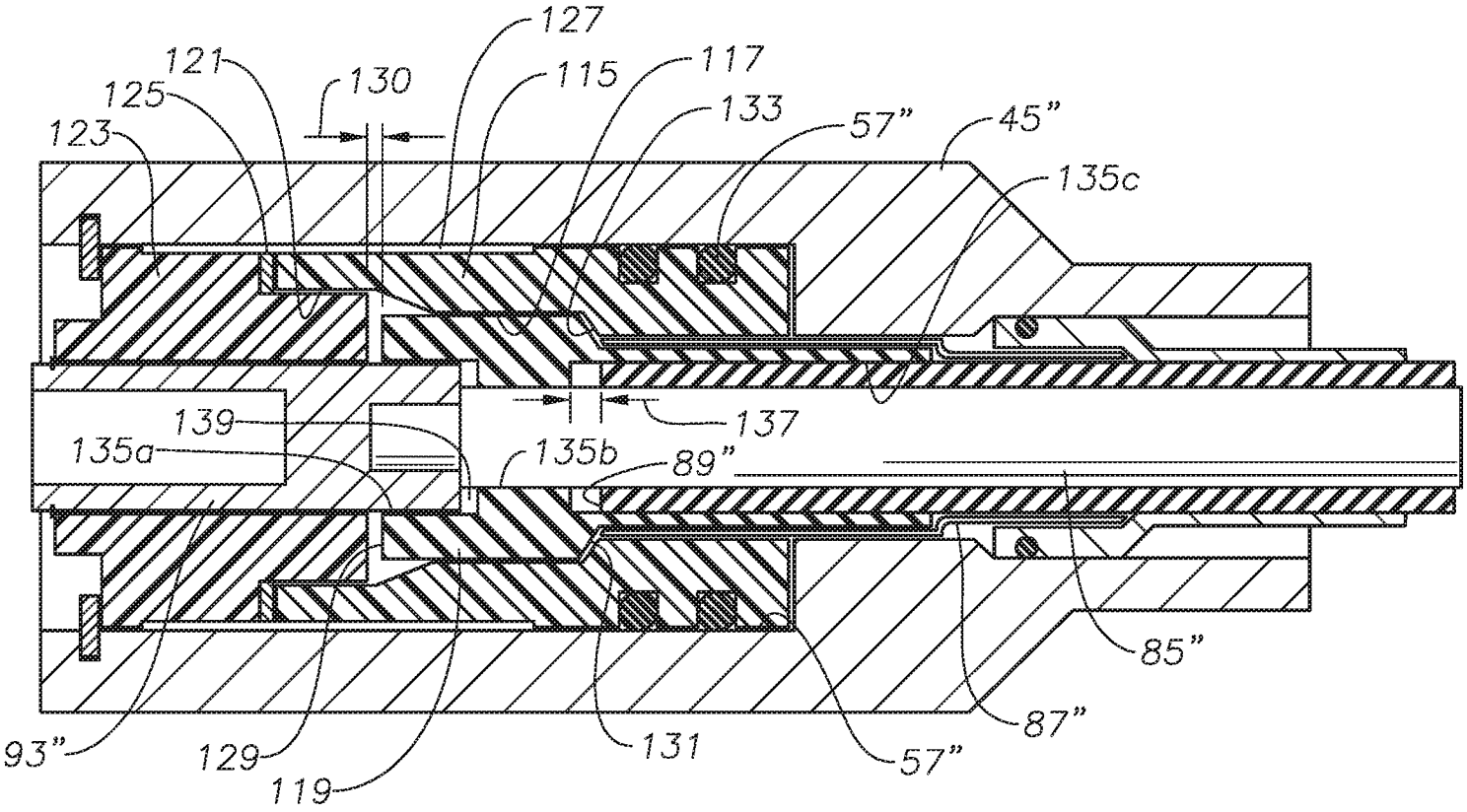
FIG. 5 is a sectional view of another alternate embodiment of the electrical connector of FIG. 3.

In FIG. 5, the components that are the same as in FIG. 3 will not be mentioned again, or if mentioned, will use the same reference numerals, but with a double prime symbol. Rearward insulator 115 is rigid and is sealed in housing cavity 51" by seals 57". Rearward insulator 115 has an axial passage 117 that receives a resilient, elastomeric grommet 119 of electrical insulation material. Rearward insulator passage 117 has a counterbore 121 on its forward end that is larger in diameter than the outer diameter of grommet 119. A rearward portion of the outer diameter of grommet 119 seals within the smaller diameter portion of rearward insulator passage 117 and a forward portion protrudes into counterbore 121 in this example.

A rigid forward insulator 123 fits within a forward portion of housing cavity 51" and has a rearward portion that inserts into rearward insulator counterbore 121. A gasket 125 of electrical insulation material may be located between a rearward facing shoulder of forward insulator 123 and the forward end of rearward insulator 115. A thin insulation sleeve 127 of electrical insulation material may surround a forward portion of rearward insulator 115, a rearward portion of forward insulator 123, and gasket 125. Gasket 125 and insulation sleeve 127 serve to resist electrical arcing between connector terminal 93" and connector housing 45". Gasket 125 and insulation sleeve 127 need not form seals.

Grommet 119 has a forward end 129 that protrudes into counterbore 121 but in this example, does not initially contact the rearward end of forward insulator 123, creating a forward gap 130. Grommet 119 has an external rearward facing shoulder 131 that may abut but does not seal to a forward facing shoulder 133 in rearward insulator passage 117. Unlike the other embodiments, grommet 119 does not extend into a passage within forward insulator 123. Grommet 119 has a smaller diameter rearward portion that may be the same as in the other embodiments.

Grommet 119 has a passage with a forward portion 135*a* that extends around a rearward portion of connector terminal 93" but does not need to form a seal. The grommet passage has an intermediate portion 135*b* of smaller diameter than forward portion 135*a*. Intermediate portion 135*b* forms a primary inner seal around an exposed portion of conductor 85". The grommet passage has a rearward portion 135*c* that closely receives conductor insulation layer 87" but does not form a seal that is capable of sealing a pressure differential as high as the inner primary seal. Rearward portion 135*c* has a larger diameter than intermediate portion 135*b*, and it may be the same as a diameter of forward portion 135*a*.

In this embodiment, intermediate passage portion 135*b* has a length that is initially less than a distance between insulation layer forward end 89" and the rearward end of connector terminal 93". Initially, a rearward gap 137 exists between insulation layer forward end 89" and the rearward end of intermediate passage portion 135*b*. An intermediate gap 139 initially exists between the forward end of intermediate passage portion 135*b* and the rearward end of connector terminal 93". The length of grommet intermediate passage portion 135*b* is thus initially less than the length of the exposed portion of conductor 85".

During operation, heat generated by motor 17 may cause grommet 119 to grow thermally relative to the other components, such as forward and rearward insulators 123, 115. Gaps 130, 137, 139 and the annular space in counterbore 121 provide room for grommet 119 to expand thermally. The thermal growth may be extensive enough for one or more of the gaps 130, 137, 139 and the annular space in counterbore 121 to substantially close up.

As in the other embodiments, during operation, grommet 119 forms the primary seal for the pressure differential between dielectric lubricant in motor 17 (FIG. 1) and well bore fluid. Grommet intermediate passage portion 135*b* forms an inner primary seal with the exposed portion of conductor 85". The outer diameter of grommet 115 forms an outer primary seal with the inner diameter of rearward insulator passage 117. Dielectric fluid may migrate around connector terminal 93" and/or forward insulator 123 into contact with the forward side of the inner primary seal formed by grommet intermediate passage portion 135*b* against the exposed portion of conductor 87". Dielectric fluid may also migrate into contact with the forward side of the outer primary seal formed between the outer diameter of grommet 119 and rearward insulator passage 117. Well fluid may migrate between the rearward portion of grommet 119 and insulator layer 87" into contact with the rearward side of the inner primary seal formed by grommet intermediate passage portion 135*b* against the exposed portion of conductor 37". Well bore fluid could also migrate into contact with the rearward side of the outer primary seal formed by the outer diameter of grommet 119 and the inner diameter of rearward insulator 115.

The present invention described herein, therefore, is well adapted to carry out the objects and attain the ends and advantages mentioned, as well as others inherent therein. While only a few embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. For example, if employed with the three conductor motor connector 33 of FIG. 1, each of the three power conductors would have a sealing grommet that seals on an exposed portion of the conductor. Also, in addition to connecting to the motor, the motor connector could be employed as part of a splice between the motor lead hard tubing and power cable. The motor connector could be located above the upper end of the motor, rather than on the upper end or head of the motor.

The invention claimed is:

1. An electrical connector for downhole well equipment, comprising:

a housing having a cavity;

a rigid rearward insulator sealed within the cavity, the rearward insulator having a rearward insulator passage;

an electrical conductor having an insulation layer and extending in a forward direction into the rearward insulator passage;

an electrical connector terminal joined to a tip of the conductor, the insulation layer having a forward end spaced a selected distance rearward from the connector terminal, defining an exposed portion of the conductor between the forward end of the insulation layer and the connector terminal; and a grommet of resilient electrical insulation material within the rearward insulator passage, the grommet having a grommet passage with a forward passage portion extending around the connector terminal, an intermediate passage portion sealing around the exposed portion of the conductor, and an outer surface in sealing engagement with the rearward insulator passage.

2. The connector according to claim 1, wherein:

the forward passage portion has a larger diameter than the intermediate passage portion.

3. The connector according to claim 1, wherein:

the grommet passage has a rearward passage portion that surrounds the insulation layer.

4. The connector according to claim 1, wherein:

the grommet passage has a rearward passage portion joining and extending rearward from the intermediate passage portion, the rearward passage portion having a larger diameter than the intermediate passage portion, defining a rearward facing shoulder in the grommet passage at a junction between the rearward passage portion and the intermediate passage portion; and a gap exists between the forward end of the insulation layer and the rearward facing shoulder in the grommet passage.

5. The connector according to claim 1, wherein:

the forward passage portion of the grommet passage has a larger diameter than the intermediate passage portion, defining a forward facing shoulder in the grommet passage at a junction between the forward passage portion and the intermediate passage portion; and a gap exists between the forward facing shoulder in the grommet passage and the rearward end of the connector terminal.

6. The connector according to claim 1, wherein:

the grommet passage has a rearward passage portion joining and extending rearward from the intermediate passage portion, the rearward passage portion having a larger diameter than the intermediate passage portion and surrounding the insulation layer; and the forward passage portion has a larger diameter than the intermediate portion.

7. The connector according to claim 1, wherein:

the rearward insulator passage has a counterbore on a forward end that surrounds but is not in sealing contact with the outer surface of the grommet.

8. The connector according to claim 1, further comprising:

a forward insulator of a rigid electrical insulating material in the cavity, the forward insulator having a forward insulator passage that registers with the rearward insulator passage, the forward insulator having a rearward end adjacent a forward end of the rearward insulator; and an outer insulator sleeve of electrical insulating material surrounding an interface between the rearward end of the forward insulator and the forward end of the rearward insulator.

9. The connector according to claim 1, further comprising:

a housing passage of smaller diameter than the cavity and extending rearward from the cavity; wherein the grommet has an external rearward facing surface;

the grommet has a rearward portion extending rearward from the rearward facing surface into but not sealing to the housing passage, the rearward portion of the grommet surrounding the insulation layer of the conductor; and an inner insulation sleeve extends around the rearward portion of the grommet and the insulation layer.

10. The connector according to claim 1, further comprising:

a housing passage of smaller diameter than the cavity and extending rearward from the cavity;

an external rearward facing surface on the grommet that abuts part of the rearward insulator;

a rearward portion of the grommet extending rearward from the rearward facing surface into the housing passage, the rearward portion of the grommet surrounding the insulation layer of the conductor; and a rigid barrier sleeve within the housing passage rearward from the rearward portion of the grommet, the barrier sleeve having an outer surface that seals to the housing passage and a barrier sleeve passage through which the conductor extends.

11. An electrical connector for downhole well equipment, comprising:

a housing having a housing passage extending forward into a cavity;

a rigid rearward insulator sealed within the cavity, the rearward insulator having a rearward insulator passage that registers with the housing passage;

an electrical conductor having an insulation layer and extending through the housing passage into the rearward insulator passage;

an electrical connector terminal joined to a tip of the conductor, the insulation layer having a forward end spaced a selected distance rearward from the connector terminal, defining an exposed portion of the conductor between the forward end of the insulation layer and the electrical connector terminal;

a grommet of resilient elastomeric material within the rearward insulator passage, the grommet having an outer surface portion in sealing engagement with the rearward insulator passage, the grommet having a rearward portion within the rearward insulator passage and the housing passage; and the grommet having a grommet passage that registers with the rearward insulator passage, the grommet passage having a forward passage portion extending around the connector terminal, an intermediate passage portion sealing around the exposed portion of the conductor, and a rearward passage portion in the rearward portion of the grommet that surrounds the insulation layer.

12. The connector according to claim 11, wherein:

the rearward passage portion of the grommet has a larger diameter than the intermediate passage portion, defining a rearward facing shoulder at a junction between the rearward passage portion and the intermediate passage portion that is spaced from the forward end of the insulation layer by a gap.

13. The connector according to claim 11, wherein:

the forward passage portion of the grommet has a larger diameter than the intermediate passage portion, defining a forward facing shoulder at a junction between the forward passage portion and the intermediate passage portion that is spaced from a rearward end of the connector terminal by a gap.

14. The connector according to claim 11, further comprising:

an inner insulation sleeve surrounding the rearward portion of the grommet and the insulation layer.

15. The connector according to claim 11, further comprising:

a rigid barrier sleeve within the housing passage rearward from the rearward portion of the grommet, the barrier sleeve having an outer surface that seals to the housing passage and a barrier sleeve passage through which the conductor extends.

16. An electrical connector for downhole well equipment, comprising:

a housing having a housing passage extending forward into a cavity, the cavity being of larger diameter than the housing passage;

a rigid rearward insulator sealed within the cavity, the rearward insulator having a rearward insulator passage, the rearward insulator passage having a forward portion of larger diameter than a rearward portion, defining a forward facing shoulder in the rearward insulator passage;

an electrical conductor having an insulation layer and extending through the housing passage into the rearward insulator passage;

an electrical connector terminal joined to a tip of the conductor, the insulation layer having a forward end spaced a selected distance rearward from the connector terminal, defining an exposed portion of the conductor between the forward end of the insulation layer and the electrical connector terminal;

a grommet of resilient electrical insulation material within the rearward insulator passage, the grommet having a forward facing surface, a rearward facing surface adjacent the forward facing shoulder in the rearward insulator passage, and a rearward portion within the rearward insulator passage;

the grommet having a grommet passage having a forward passage portion extending around a rearward portion of the connector terminal, an intermediate passage portion sealing around the exposed portion of the conductor, and a rearward passage portion in the rearward portion of the grommet that surrounds the insulation layer;

a forward insulator of a rigid electrical insulating material in the cavity forward of the rearward insulator, the forward insulator having a forward insulator passage that receives a forward portion of the connector terminal; and wherein the intermediate passage portion has a length less than a distance from a rearward end of the connector terminal to the forward end of the insulation layer.

17. The connector according to claim 16, further comprising:

a rigid barrier sleeve within the housing passage rearward from the rearward portion of the grommet, the barrier sleeve having an outer surface that seals to the housing passage and a barrier sleeve passage through which the insulation layer of the conductor extends.

18. The connector according to claim 16, further comprising:

an inner insulation sleeve surrounding the rearward portion of the grommet and the insulation layer;

a rigid barrier sleeve within the housing passage rearward from the rearward portion of the grommet, the barrier sleeve having an outer surface that seals to the housing passage and a barrier sleeve passage through which the insulation of the conductor extends; and the barrier sleeve passage having a forward portion larger in diameter than a rearward portion of the barrier sleeve and into which the inner insulation sleeve extends.

19. The connector according to claim 16, further comprising:

an outer insulator sleeve of electrical insulating material surrounding an interface between a rearward end of the forward insulator and a forward end of the rearward insulator.

20. The connector according to claim 16, wherein:

the intermediate portion of the grommet passage has a smaller diameter than the forward portion and the rearward portion of the grommet passage;

a rearward gap exists between a rearward end of the intermediate portion and the forward end of insulation sleeve;

an intermediate gap exists between a forward end of the intermediate portion and a rearward end of the connector terminal; and a forward gas exists between a forward end of the grommet and a rearward end of the forward insulator.

* * * * *